United States Patent [19]

Fujii et al.

[11] 4,405,295

[45] Sep. 20, 1983

[54] METHOD OF MANUFACTURING COMPLEX METALLIC PLATE

[75] Inventors: Tetsuya Fujii; Yukio Oguchi; Norio Sumita, all of Chiba; Isamu Goto, Kobe, all of Japan

[73] Assignee: AMSTED Industries Incorporated, Chicago, Ill.

[21] Appl. No.: 353,400

[22] Filed: Mar. 1, 1982

[51] Int. Cl.[3] ..... B22F 7/02

[52] U.S. Cl. ..... 419/28; 419/50; 164/66.1

[58] Field of Search ..... 75/201, 208 R, 226, 75/223; 428/558, 565; 164/66.1; 419/28, 50

[56] References Cited

U.S. PATENT DOCUMENTS

| | | | |
|---|---|---|---|
| 1,703,416 | 2/1929 | Donaldson | 428/558 |
| 3,384,481 | 5/1968 | Broverman | 75/201 |
| 3,650,313 | 3/1972 | Balevski et al. | 164/66.1 X |
| 3,853,550 | 12/1974 | Nikolaev et al. | 75/223 X |
| 3,982,904 | 9/1976 | Nayar | 75/208 R X |
| 4,069,042 | 1/1978 | Buchovecky et al. | 75/224 X |
| 4,126,451 | 11/1978 | Nayar | 75/208 R |
| 4,127,700 | 11/1978 | Stöckel et al. | 75/208 R X |
| 4,259,413 | 3/1981 | Taglang et al. | 75/208 R X |

FOREIGN PATENT DOCUMENTS

| | | | |
|---|---|---|---|
| 48-25610 | 4/1973 | Japan | 75/223 |

*Primary Examiner*—Brooks H. Hunt
*Assistant Examiner*—Matthew A. Thexton
*Attorney, Agent, or Firm*—Edward J. Brosius; Fred P. Kostka

[57] ABSTRACT

The present invention provides a method for manufacturing complex metallic plates. A hollow metal piece, which will form the outer layer, is first made. A powder which will form the inner layer is then filled within the hollow metal piece. The multi-layer plate is then manufactured by hot-rolling the metal piece.

4 Claims, 7 Drawing Figures

METHOD OF MANUFACTURING COMPLEX METALLIC PLATE

BACKGROUND OF THE INVENTION

This invention deals with a method for manufacturing complex metallic plates. At first the hollow metal piece, which will form the outer layer, is made. Then the metallic powder which will become the inner layer is filled in the metal piece. A multi-layer metallic plate can be manufactured by hot-rolling the above metal piece.

In the past, manufacturing complex metallic plates by first making the hollow metal piece for the outer layer and then pouring casting metal into the hollow part has been one of the typical methods of manufacturing complex metallic plates. However, this method is not suitable for mass production and has only been industrialized in special fields, such as the manufacture of rollers for rolling machines. For example, a well-known method is to make hollow metal pieces by casting metal for the outer layer into the mold and by draining unsolidified metal from the bottom of the mold after a certain thickness of solidified metal is molded. Then, the molten metal which will make the inner layer is poured inside of this molded metal.

The present method is also a good example from the point of view of obtaining excellent adhesive surfaces between layers of metals. In order to obtain the excellent adhesive surfaces by preventing air oxidation of the inside of the hollow metal piece when the molten metal for the outer layer is poured, flux with low oxygen or organic resin is applied to the inner surfaces of the hollow metal beforehand. This method is considerably effective in preventing air oxidation and in preventing the agglutination of the oxide particles which will be formed during the injection of the molten metal to surfaces.

However, these prior art methods all require the pouring of the molten metal inside the hollow metal piece. In the process of solidification of the molten metal which will become the inner layer, problems such as considerable segregation occur in many cases. Further, any interpositions would adhere to the surfaces and cause poor adhesion. That would result in a metallic plate of poor mechanical quality.

SUMMARY OF THE INVENTION

The present invention overcomes the disadvantages of the prior art methods of pouring molten metal inside of a hollow metal piece. By use of the method of the present invention the mixing of metal powder and powder of inorganic substances such as ceramic is made possible.

The present invention provides a method of manufacturing complex metallic plate by hot-rolling a hollow metal piece after metal powder, powders of inorganic substances such as ceramic and mixtures of these powders are filled inside.

The present invention also provides a method of manufacturing complex metallic plate by rolling the hollow metal piece after metal powder, powders of inorganic substances such as ceramic and the mixture of these powders are filled inside the metal piece. The hollow metal piece is manufactured by applying pressure to inject molten metal into the mold and solidifying the metal to the specified thickness. Then unsolidified metal can then be extracted to a receptacle or ladle.

DETAILED DESCRIPTION OF THE PREFERRED EMBODIMENTS

The following explanations of the construction and the actual example of this invention illustrates the method for manufacturing the complex metal using a pressure injection system. However, making complex metallic plate by hot-rolling a metal piece after metal powder is filled inside the metal hollow part does not necessarily require such a hollow metal piece manufactured by such a pressure injection system.

Figure 1:
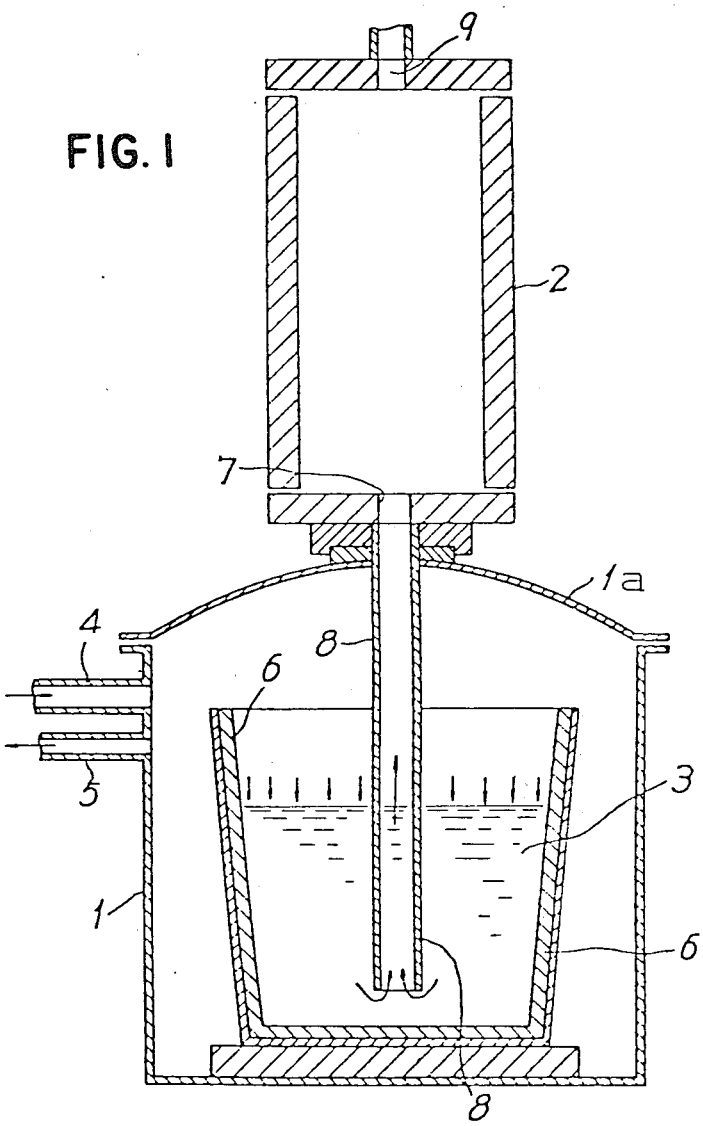
FIG. 1 is a cross sectional view of a pouring tank, and mold suitable for carrying out the present invention.
Figure 2:
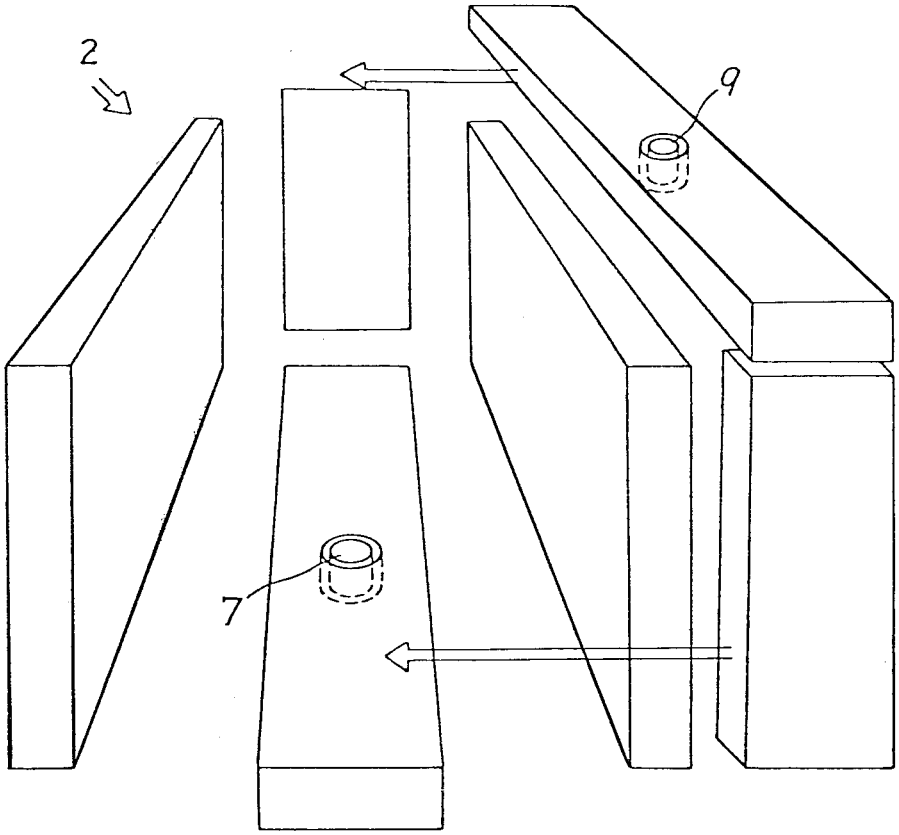
FIG. 2 is a perspective view of sections of a mold suitable for casting plates in accordance with the present invention.

Method and equipment for manufacturing the metal piece will now be described. FIG. 1 illustrates that applying air pressure will inject the molten metal 3 into the mold 2, which is set on the tank 1, to form a hollow metal piece. The tank 1 is air-tight for increasing and decreasing air pressure and is equipped with pressure gas induction pipe 4 and release pipe 5. A receptacle or ladle 6 to store the molten metal is placed inside tank 1. Mold 2 is placed on lid 1A of tank 1 and the tank 1 are connected by injection pipe 8. The bottom of pipe 8 is in molten metal 3 and the top is connected to the injection hole in the bottom of mold 2. By inducting pressure gas to increase pressure in the tank, the molten metal 3 in receptacle 6 will go up injection pipe 8 and into mold 2. After the molten metal reaches a predetermined height of the mold 2, the metal is allowed to solidify by maintaining constant pressure. Unsolidified metal will flow down to receptacle 6 by gradually reducing the pressure in tank 1 after the desired thickness of metal is solidified to form a hollow metal piece 10 (outer layer). To make the inner layer in the hollow metal piece, inactive gas such as argon will first be introduced from hole 9 on top of mold 2; then metal and other desired powders are introduced from hole 9.

In regard to the above mentioned method of manufacturing a hollow metal piece, this invention has certain distinct advantages. One is that it uses pressure to inject and to extract molten metal. This is an extremely effective way to extract the unsolidified metal. Because the solidifying molten metal has low liquidity and is highly agglutinative, it is very difficult to drain it completely from the mold without the use of such pressure.

Experience has proven that the manufacturing method of the present invention does not require a special nozzle such as a sliding nozzle. This makes it possible to force out unsolidified metal from the mold completely by decreasing pressure in the tank. An inactive gas is filled into the hollow portion of the casting preferably during or alternatively right after the extraction of unsolidified metals. This prevents the inner surfaces of the hollow metal casting from coming into contact with oxygen containing gas and the resultant development of oxidizing scale on the inner surfaces of the hollow metal piece during the manufacturing process. The above explanation illustrates the method of injecting molten metal into the mold by applying pressure in the airtight tank. However, the same operation could work on the mold by decreasing the pressure in the mold to siphon the molten metal and by releasing the pressure later to force the unsolidified metal out. However, a combination of the above two methods could be utilized at the same time.

The above-mentioned mold should have a hole on the top and an injection hole at the bottom. A sectional mold is desirable, being more convenient to unmold. The connecting seal should be of such quality that air will not enter nor that molten metal will flow out.

The hollow metal piece manufactured by the method set forth above will be filled with metal or other nonmetallic powders that will form the inner layer. The metal piece will then be placed like an input in the furnace and rolled out to the specified thickness.

The powder should be filled into the hollow metal piece as evenly as possible to keep clad ratio (ratio of thickness of product and surface metal) constant. Vibration is found to be effective in enabling the powder to be compacted more densely. After the filling is completed, injecting hole 7 should be closed by welding. However, sealing it completely might cause an explosion during the hot-rolling process. To solve this problem and to prevent oxidation of the powders and inner surfaces of the metal piece, the sealing design seen in FIG. 3 was employed.

Figure 3:
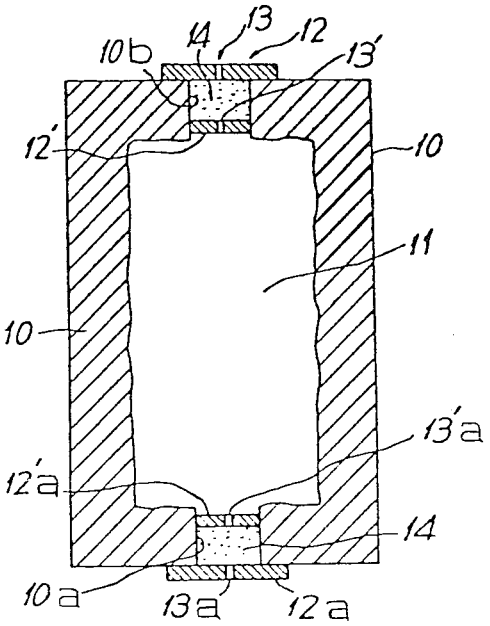
FIG. 3 is a cross sectional view of a hollow metal plate made in accordance with the present invention.

As shown in FIG. 3, both injection hole 10*a* and top hole 10*b* will be closed with two lid plates 12,12', 12*a*,12*a*' made from the same material as the hollow metal piece. All of these plates have a ventilation hole 13,13',13*a*,13*a*' and carbonaceous powder 14 will be poured between the two plates. This enables the gas from metal powders to diffuse into the air through the ventilation holes. Moreover, atmospheric gas that enters has to go through the highly heated carbonaceous powder 14 and the oxygen in the gas will change it to CO gas. This prevents the oxidation of the inside surface of hollow metal piece 10.

The complex metal piece manufactured as described above is then designed to be hot-rolled. The metal powders 11 inside will sinter during the heating process and will become one piece after being rolled. Since the oxidation of the powders is prevented as previously described, hollow metal and the inside powders adhere well during the hot-rolling process.

In short, one of the characteristics of this invention is to fill metal and other powders in the hollow metal piece 10 to make complex metal. The use of powders leads to an extremely even inner layer. The metal powder method prevents oxidation of the inside surfaces, which is common in the liquid metal injection method. It also produces even adhesiveness between the surface of layers and enables the manufacture of excellent complex metallic plate.

Filling materials do not necessarily have to be metal powders, inorganic powders or a combination of metal and inorganic powders could also be used. It is possible to choose different filling materials according to the use of the metallic plate. For example, when the metallic plate is for anti-rust purposes, using stainless steel for hollow metal pieces and iron powder as filling (not expensive alloying elements like Ni or Cr) could show substantial savings. Also, highly adiabatic plate could be made by using regular steel and mixture of powders of iron and ceramic such as $Al_2O_3$. The ceramic layer is expected to be effectively adiabatic. Further, a mixture of fibrous material and metal powder could be used as filling to make mechanically strong metallic plate. Specific examples of the use of the method of the present invention are set forth below.

EXAMPLE 1

Metal for the outer layer was obtained by melting about 50 tons SUS304 stainless steel in an electric furnace. Chemical composition of this metal is in chart 1.

CHART 1

| Composition of molten SUS304 stainless steel (% by weight) (balance essentially Fe) | | | | | | | |
|---|---|---|---|---|---|---|---|
| C | Si | Mn | P | S | Al | Cr | Ni |
| 0.06 | 0.64 | 1.6 | 0.019 | 0.011 | 0.025 | 18.3 | 8.6 |

The receptacle with molten stainless steel was placed inside the tank and an anti-flammable injection pipe was installed through the injection hole of the graphite mold, which is set on the tank. Increase of pressure in the tank forced the molten steel at 1610° C. to go up in the mold. The mold was made of six graphite blocks and inside surfaces were coated with powdered $Al_2O_3$. The dimensions of the mold are 200 mm thick, 1000 mm height, 5000 mm length, for manufacturing an 8 ton slab. It took 40 seconds for molten steel to reach the top hole. The pressure was held steady for about 200 seconds to allow the metal to solidify. Then the pressure was released to the normal point to extract unsolidified metal into the receptacle, and at the same time highly pure Ar gas with less than 30 ppm oxygen was injected from the top hole to fill the inside. While the hollow metal piece was cooling, Ar gas was injected a the rate of 50 l/min. After the metal was cooled down, the mold was disassembled to remove the metal.

The above hollow metal piece was filled with atomized iron powder. Chemical components and properties of this iron powder are shown in Chart 2.

CHART 2

| Properties of the iron powder. COMPONENTS (% by weight) (balance essentially Fe) | | | | | | Apparent density |
|---|---|---|---|---|---|---|
| C | Si | Mn | P | S | O | (g/cm$^3$) |
| 0.012 | 0.03 | 0.21 | 0.008 | 0.010 | 0.28 | 2.89 |

| Granularity Distribution (mesh, %) | | | | | |
|---|---|---|---|---|---|
| +100 | +150 | +200 | +250 | +325 | −325 |
| 15.4 | 21.6 | 18.4 | 12.4 | 15.7 | 16.5 |

During the filling process, an ingot vibrator was used to vibrate the hollow metal in order to fill 20% more densely than apparent density. Once the powder was introduced the injecting and top holes were closed by welding according to the method described above and illustrated in FIG. 3. Each set of lid plates is made of 20 mm SUS304 stainless steel with three ventilation holes of 3 mm diameter. 100 g of graphite powder was filled in the space between the two plates.

Figure 4:
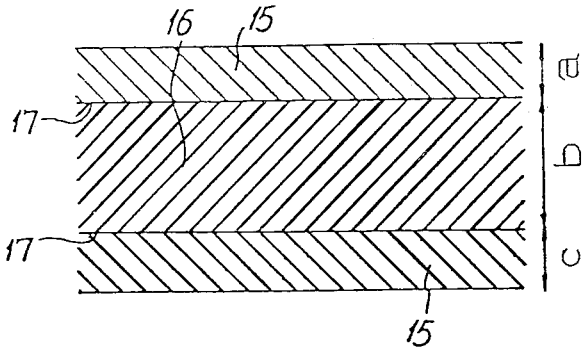
FIG. 4 is a cross sectional view of a section of a complex metallic plate made in accordance with the present invention.

The complex metal piece made in the above manner was put through the regular rolling process to manufacture hot-rolled plate. Samples were taken from a strip of this plate and exfoliation tests were carried out to examine the adhesiveness between layers. The test method used was clad steel exfoliation by ASTMAA-264 standard. Surface adhesion strength was measured by pulling and the results are shown in Chart 3. All the sample pieces met the standard (more than 14.1 kg/mm$^2$) and proved to be a highly and evenly adhered product. Using the same sample pieces, clad ratio, which represents not only adhesive strength but also quality properties, is recorded. As shown in FIG. 4, the clad ratio is the ratio of the thickness of whole clad steel plate, which consists of outer stainless steel layers 15 and the inner common steel layer 16, and the thickness of one outer stainless steel layer $(a+b)/2(a+b+c)$. The result in Chart 4 shows the ratios at each point were all within 19–25% range. Approximately constant clad ratios were obtained with the variance of ±3.0%.

Figure 5:
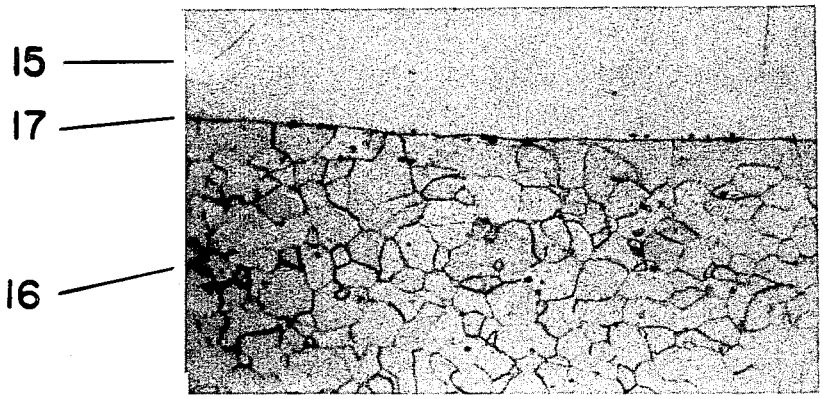
FIG. 5 is a photomicrograph of a section of the plate of FIG. 4, showing the microstructure of the plate.

FIG. 5 is a photo micrograph (×400, nitric acid solution eroded) of the cross-sectional view of the formation of this hot-rolled plate (3 mm). Crystals in the iron powder layer 16 are smaller than usual rolled irons. Although microscopic interpositions under 1μ were seen, layers are observed completely adhered.

Density is believed to represent the material properties of this iron powder layer. Apparent density was counted from a piece taken from iron powder layer of 20 mm sheet ar. The result was 7.69–7.82 g/cm$^3$, which is 97.7–99.4% of pure iron's real density, 7.87 g/cm$^3$. The iron powder was observed to be completely cohered.

Figure 6:
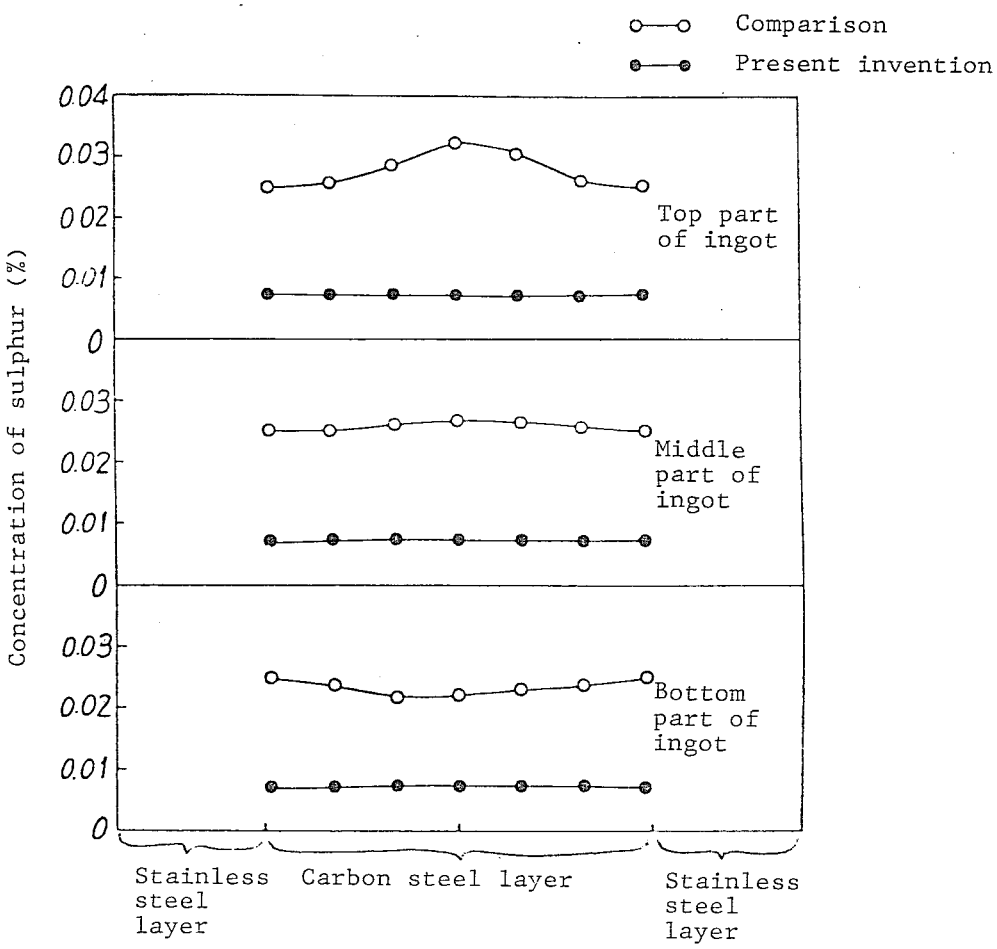
FIG. 6 is a graph of the S concentration versus depth of a plate made in accordance with the present invention.
Figure 7:
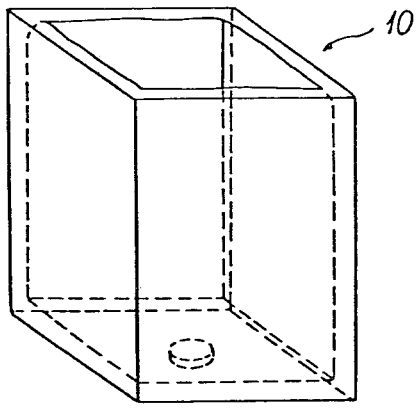
FIG. 7 is a perspective view of a hollow metal piece made in accordance with the present invention.

FIG. 6 shows the distribution of S concentration of 22 mm rolled plate. Comparison counts were from the complex metal piece which was made from the same stainless steel hollow metal but filled with solidified low carbon Al killed metal (molten metal was injected from the bottom previously).

Comparison counts show at the edges of the plate P, S segregation of the inner layer is great. But with the iron powder layer, segregation was not observed anywhere in the plate. The present invention has proven to produce complex metallic plates of extremely even constituency.

The next experiment was on the complex metal plate of which the inner layer was made of the mixture of ceramic and iron in order to obtain better adiabatic ability.

CHART 3

| 8 mm Heat Rolled Plate Exfoliation Test Adhesive Strength (kg/mm$^2$) | | | | | | |
|---|---|---|---|---|---|---|
| | | Coil Length Direction | | | | |
| | | Edge | ¼ | Center | ¾ | Edge |
| Coil | ¼ | 21 | 22 | 19 | 21 | 22 |
| Width | Center | 23 | 25 | 21 | 23 | 25 |
| Direction | ¾ | 19 | 25 | 21 | 22 | 25 |

CHART 4

| | | Clad Ratio (%) | | | | |
|---|---|---|---|---|---|---|
| | | Coil Length Direction | | | | |
| | | Edge | ¼ | Center | ¾ | Edge |
| Coil | ¼ | 24 | 25 | 25 | 24 | 25 |

CHART 4-continued

| | | Clad Ratio (%) | | | | |
|---|---|---|---|---|---|---|
| | | Coil Length Direction | | | | |
| | | Edge | ¼ | Center | ¾ | Edge |
| Width | Center | 23 | 22 | 22 | 22 | 22 |
| Direction | ¾ | 19 | 20 | 20 | 19 | 20 |

EXAMPLE 2

Using the same equipment as in Example 1, identical SUS304 stainless steel was injected into the mold of inner measurement 400 mm long, 500 mm wide and 900 mm high. A hollow metal piece of 40 mm thickness was manufactured in the same manner as in Example 1. Inside, this metal was filled with the mixture of the powder of $Al_2O_3$ and Stainless steel. The mixing ratio was 1:1 volume-wise. 15 mm pure stainless steel powder was placed between the stainless steel layer and powder layer to improve adhesiveness. The properties of this stainless steel were described in Chart 5 then this was sealed with SUS304 stainless steel plates by welding. Ventilation holes were made as shown in FIG. 3, and between the lid plates, carbon powder was filled. The metal piece so formed was rolled out by the usual heat-rolling metal.

A proportion of the layers of the hot-rolled metal of 4 mm thickness was checked by cross section. The stainless steel layers (total of two layers) were 38–41% and mixture layer (stainless steel and $Al_2O_3$ powders mixture) was 59–62%. Heat conductivity was also checked on this 4 mm rolled plate. It showed 6.5–7.1 K cal/m hr°C. which is 65–70% of the heat conductivity of regular stainless steel. The adiabatic ability was improved 30–35%.

CHART 5

| Properties of Stainless Steel Powder | | | | | | | |
|---|---|---|---|---|---|---|---|
| COMPONENTS (% by weight) balance essentially Fe. | | | | | | | Apparent Density |
| C | Si | Mn | P | S | Cr | Ni | (g/cm$^3$) |
| 0.03 | 0.31 | 1.1 | 0.02 | 0.011 | 18.5 | 8.8 | 2.75 |

| Granular Distribution (mesh, %) | | | | | |
|---|---|---|---|---|---|
| +100 | +150 | +200 | +250 | +325 | −325 |
| 19.3 | 18.6 | 16.4 | 13.5 | 15.1 | 17.1 |

We claim:

1. A method of producing complex metallic plate comprising the steps of pressure injecting an iron base molten metal into a mold through an injection hole in the botom of the mold, after the metal has reached predetermined height, allowing the metal to partially solidify by maintaining a near constant pressure, after a predetermined thickness of metal has solidified, reducing the pressure in the mold to allow unsolidified metal to run out and thusly form a hollow metal piece, injecting an inactive gas into the hollow metal piece, filling the hollow metal piece with a metal powder mixture to form a filled metal piece, sealing each of the top and bottom openings in the hollow metal piece with two plates of a metal similar to the molten metal and each having at least one ventilation hole with a carbon base powder between said two plates, sintering said filled metal piece and rolling said heated filled metal piece to form a complex metallic plate.

2. The method of claim 1 wherein the molten metal is a stainless steel and the metal powder is an iron base powder.

3. The method of claim 1 wherein the metal powder is a mixture of an iron base powder and a ceramic powder.

4. The method of claim 1 wherein the mold comprises graphite blocks the inside surfaces of which are coated with a ceramic powder prior to the injection of the molten metal.

* * * * *